United States Patent [19]

Fickler

[11] Patent Number: 4,458,370

[45] Date of Patent: Jul. 10, 1984

[54] DEVICE FOR ADJUSTING THE ANGULAR POSITION OF A MOVABLE SUPPORTING SURFACE

[76] Inventor: Hans Fickler, Weidstrasse 18, CH-8542 Wiesendangen, Switzerland

[21] Appl. No.: 414,460

[22] Filed: Sep. 2, 1982

[30] Foreign Application Priority Data

Sep. 9, 1981 [CH] Switzerland ..... 5816/81

[51] Int. Cl.[3] ..... A61G 7/06

[52] U.S. Cl. ..... 5/71; 5/66; 5/433; 248/118; 248/455

[58] Field of Search ..... 5/52 B, 52 D, 66–69, 5/71, 72, 76, 78, 431–433; 297/355; 248/118, 455

[56] References Cited

U.S. PATENT DOCUMENTS

| | | | |
|---|---|---|---|
| 858,908 | 7/1907 | Rauch | 5/71 |
| 2,666,216 | 1/1954 | Schnaitter | 5/71 |
| 2,918,682 | 12/1959 | Thoreson et al. | 5/432 |
| 3,916,461 | 11/1975 | Kerstholt | 5/66 |

FOREIGN PATENT DOCUMENTS

| | | | |
|---|---|---|---|
| 78466 | 12/1894 | Fed. Rep. of Germany | 5/72 |
| 2018083 | 2/1982 | United Kingdom | 5/67 |

*Primary Examiner*—Alexander Grosz
*Assistant Examiner*—Michael F. Trettel
*Attorney, Agent, or Firm*—Thomas W. Speckman

[57] ABSTRACT

A device for adjusting the angular position of a movable support has two frames which are pivotally connected to each other along a pivot axis and are capable of being moved apart by the action of pretensioned torsion spring rods provided near the pivot axis so that the two frames assume variable angular positions with respect to each other. The movable support frame in its upwardly directed angular position may serve as a supporting surface for a mattress at the head end of a bed frame. To effect angular adjustment, two steel cables fastened to one frame are trained over pulleys disposed on the other frame and are guided to a pivot lever pivotably attached to the other frame and are actuated by an electric motor. As the motor is operative, the steel cables cause the frames to be pulled in one direction toward each other against the action of the torsion spring rods and the pneumatic springs. Reversing the direction of the motor will cause the frames to move away from each other due to the action of the torsion spring rods and pneumatic springs.

10 Claims, 1 Drawing Figure

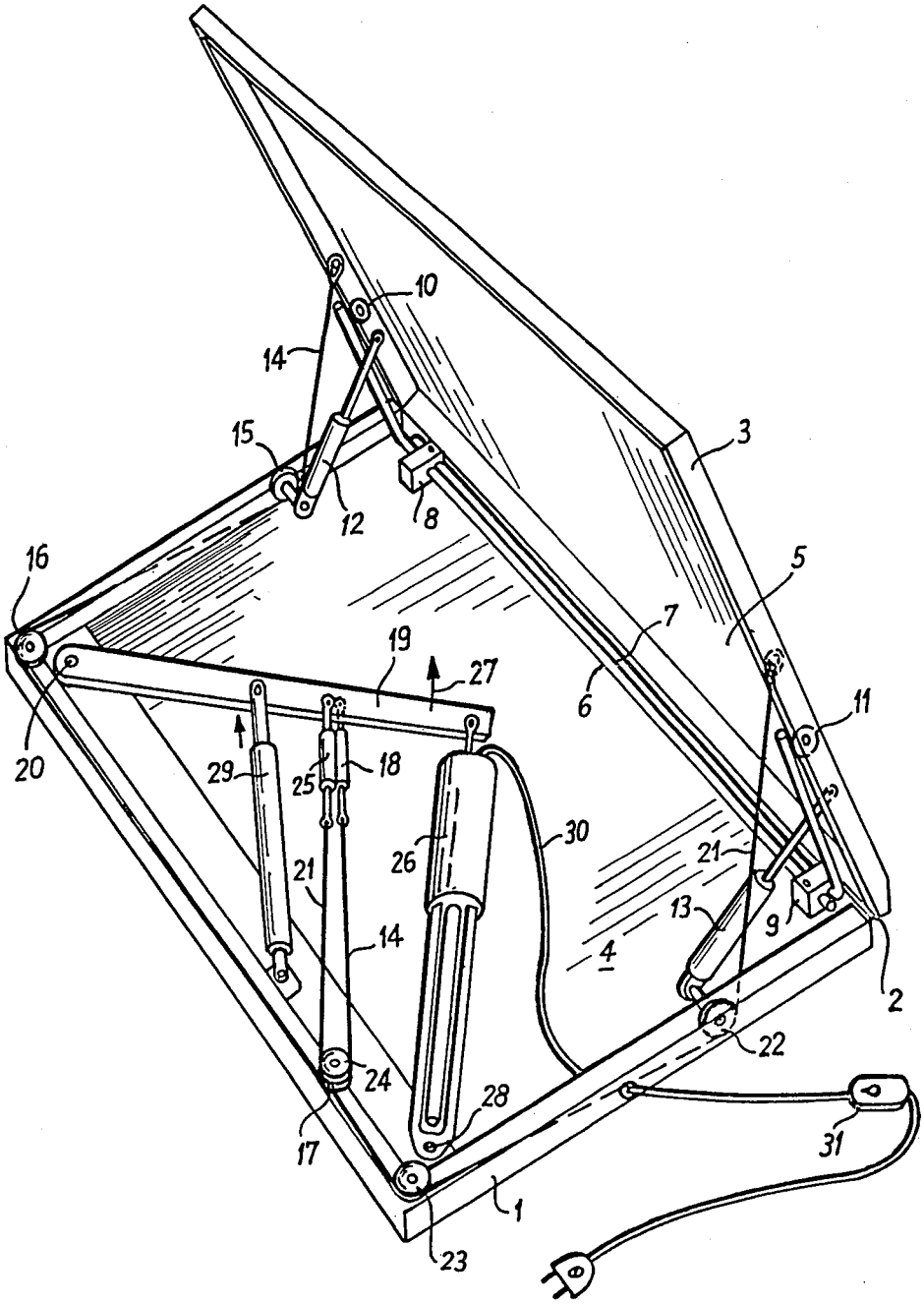
10
14
15
12
8
3
16
5
7
19
27
6
11
20
29
25
18
30
26
21
21
13
9
14
4
2
22
24
28
31
17
1
23

DEVICE FOR ADJUSTING THE ANGULAR POSITION OF A MOVABLE SUPPORTING SURFACE

BACKGROUND OF THE INVENTION

This invention relates to a device for adjusting the angular position of a movable supporting surface, in particular the head section of a bedstead supporting the head end of a mattress.

Bed frames are known which have an adjustable head and/or foot section capable of being moved up about an axis of rotation parallel to the horizontal foundation of the bed by crank drive means. Because of the restricted space available between the lower portions of the bed and the floor, the use of long crank arms for adjusting the bed sections is not possible. Instead, compact but powerful drive means are required to do the job and they represent the highest of the cost factors for beds of this type.

Bed frames of the foregoing type are used mostly in hospitals and nursing facilities, but also in private homes. However, they are quite expensive since the adjustable head and/or foot section is an integral part of the specially constructed bed frame. The patient should be able to adjust particularly the head section himself so as to choose the most comfortable position for eating and reading, for example, without outside assistance. This operation requires a drive motor to adjust the particular adjustable bed frame.

SUMMARY OF THE INVENTION

It is an object of the present invention to provide a device for raising a portion of the horizontal surface of a bed, particularly the head end, for use with any standard bed frame, which device is operated by a drive motor and is easy to transport so as to be applied successively to more than one bed, and which is substantially more cost effective than conventional devices of this kind.

If the device is to be used with any standard bed frame, the space underneath the surface supporting the mattress cannot be used for accommodating the drive and adjusting means because of the great many different constructions of the bed foundation, such as the mattress support, being slats or box springs, and the like. Thus, the object is to accommodate all parts required for the raising and lowering of a supporting surface, including the drive means, in the smallest space possible because, when not in use, the lowered supporting surface of the device disposed under the mattress must not interfere with the patient's reclining comfort and generally must not become an annoyance in any ways. Consequently, the device should be of an extremely flat configuration.

This is accomplished according to the invention by the device being made of two frames which are hinged together along one of their edges. One frame serves as the base portion to be placed horizontally upon a bed foundation surface, and the other frame constitutes the supporting surface which is adjustable to various angular positions with respect to the horizontal base frame. The frames are adapted to be spread apart, by increasing the angle between the base frame and the supporting frame, by means of at least one torsion spring rod disposed alongside the pivot axis between the frames, and at least one pneumatic spring likewise disposed between and braced against the two frames. The two frames are connected to each other by flexible pull means which coact with drive means secured to one frame to enable the frames to move toward and away from each other against the action of the torsional spring rods and pneumatically operated springs for the purpose of achieving an infinitely variable adjustment of the angle between the two frames.

Each of two torsion spring rods, which extend parallel to the pivot axis and each other, is secured with one end to the respective opposite side of one frame, while the other end, making an angle of 90° to the horizontal run, is urged against a roller, such rollers being provided at opposite sides of the other frame.

Furthermore, two pneumatic springs are provided, each of which is joined to the opposite side of one frame, with one end, and with the other end to opposite sides of the other frame. This results in the combined action of a torsion spring rod and a pneumatic spring at each side of the frame assembly to move the frame forming the supporting surface upward. On each frame side, the torsion spring and the pneumatic spring are so arranged with respect to each other that, as the angle between the two frames increases and the resilient force of the pretensioned torsion spring rod decreases, the momentum of the pneumatic spring is continuously increasing in favor of an increasing angular distance between the frames. The torsion spring rod having an intitial angular bias of 50° is further tensioned by approximately 70° as the two frames are pulled toward each other. This strong resilient force decreases during the upward movement of the supporting frame and the same time the pneumatic spring, acting in the same direction, exerts an increasing force on the frame by way of an increasingly effective lever arm.

Secured to each of the two opposite sides of one frame is a steel cable serving as a flexible pulling means. The two steel cables are trained over pulleys provided on the other frame and with their other ends fastened to a pivot lever mounted on the other frame. The lever is adapted to be operated by an electric hoisting motor disposed on the frame and having a threaded spindle linked to the pivot lever. As the pivot lever is rotated by the motor in one direction, the other frame, against the action of the torsion spring rods and the pneumatic springs, is lowered toward the horizontal frame by the pulling action of the steel cables, whereas a rotation of the pivot lever by the motor in the other direction of movement will release the frame, held by the steel cables, for upward movement.

BRIEF DESCRIPTION OF THE DRAWING

The invention will be further described with reference to a representative embodiment illustrated in the drawing, showing in a perspective view, not to scale, the principle underlying the inventive device.

DESCRIPTION OF PREFERRED EMBODIMENTS

The device comprises frame 1 to be placed upon a horizontal base, particularly a bedstead, not illustrated in the drawing, and frame 3 of substantially the same size as frame 1 hinged to frame 1 along pivot axis 2. The width of the frames 1 and 3 as measured parallel to pivot axis 2, corresponds approximately to the width of a bed frame. Frames 1 and 3 have covers 4 and 5, respectively, fastened to their outer edges, so that the outward appearance of the device resembles a very flat suitcase or a briefcase. Frame 3 with its cover 5 forms the supporting surface for the head section of a mattress, not shown in the drawing. The supporting surface is to be adjustable in its angular position with respect to horizontal frame 1 and this is to be accomplished with the assistance of a motor.

Extending parallel to pivot axis 2 in bottom frame 1 and almost across the entire width of frame 1 are two torsion spring rods 6 and 7 supported in two bearing blocks 8 and 9. The foremost torsion spring rod 6 makes a 90° angle beyond bearing block 8, as viewed in the drawing. Its straight end is secured against rotation in bearing block 9 so that the entire straight run of the torsion spring rod is capable of torsional motion. Torsion spring rod 7 is angularly bent at 90° in front of bearing block 9, again as viewed in the drawing, and its free end is fixedly secured against rotation in bearing block 8. The angular ends of the two torsion spring rods 6 and 7 are urged against roller means 10 and 11, respectively, which are disposed at the inner side of opposite sections of frame 3. When frame 3 is moving, the two angular ends of the two torsion spring rods are caused to move relative to the rollers 10 and 11. In the operative postion of frame 3 illustrated in the drawing, with an angle of about 70° between the frames, the two torsion spring rods 6 and 7 which had previously been installed at a pretension, have a tension corresponding to an angle of rotation of 50°. The two torsional spring rods operate to increase the angle between the two frames, with the strongest force being exerted when frames 1 and 3 are placed parallel above each other.

In addition, two pneumatic springs 12 and 13 are fastened to the opposite sides of the two frames, one end of each spring being attached to frame 1 and the other end to frame 3.

Each penumatic spring exerts a pressure of approximately 40 kg to bring about an increase in the angular distance between two frames 1 and 3. When frames 1 and 3 lie parallel one above the other, the pneumatic spring is able to act on frame 3 only by means of a very short lever arm. As the resilient force of the two torsion spring rods 6 and 7 decreases with an increasing angle between the frames, proceeding from the superimposed parallel postion of frames 1 and 3, the force exerted by the pneumatic springs steadily increases due to the increasing length of the effective lever arm, so that a force which is subject to minor fluctuations only is effective between the two frames for the purpose of adjusting their angular distance.

This effective spring force is counteracted by a pulley and cable assembly applying a pulling force to frames 1 and 3 to move them toward each other. A first steel cable 14 is fastened with one end to frame 3, is trained over pulley 15 rotatably mounted on frame 1 in the general area of penumatic spring 12, is passed over a further pulley 16 disposed in a corner of frame 1, finally is trained over a pulley 17 located at the long side of frame 1, and its end is fastened to a tensioning means 18 which is secured to pivot lever 19. Lever 19 is pivotably mounted on frame 1 by means of pivot pin 20.

A second steel cable 21 is fastened with one end to the opposite side of frame 3, is trained over pulley 22 disposed on frame 1 in the general area of pneumatic spring 13, is passed over another pulley 23 disposed in a corner of frame 1 and is finally guided over a pulley 24 disposed at the long side of frame 1 and mounted on the same shaft as pulley 17 for steel cable 14.

The end of steel cable 21 is attached to a tensioning member 25 which, like tensioning member 18, is secured to pivot lever 19. For the sake of clarity, the drawing shows the tensioning members 18 and 25 as being attached to pivot lever 19 adjacent to each other, while in reality, however, the fastening ends of the steel cables 14 and 21 are attached to the pivot lever 19 one above the other, because otherwise the steel cables would be subject to an uneven pulling force.

Pivot lever 19 is moved in the direction of the arrow 27 by means of an electric hoisting motor 26, whereby frame 3, due to the pulling action of the two steel cables 14 and 21, is pulled toward lower frame 1, against the action of the two torsion spring rods 6 and 7 and the two penumatic springs 12 and 13. In the final position, motor 26 may be reversed to move frame 3 in the opposite direction into any desired angular position with respect to frame 1. Motor 26 is pivotably mounted on frame 1 by means of pivot pin 28 to enable the motor to execute the lateral movement required as a result of the movement of the connecting point between motor and pivot lever 19 along a circular arc. In order to have room for motor 26 in the space between the two frames 1 and 3, or the covers 4 and 5, respectively, the diameter of the motor must be kept to a minimum. Consequently, the motor selected is somewhat smaller than the work requires and is therefore aided by a pneumatic spring 29, disposed in parallel to motor 26, with one end being likewise pivotably attached to lever 19 and with the other end to frame 1. Pneumatic spring 29 exerts a force upon pivot lever 19 in the direction of its indicated movement whereby a decrease in the angle between the frames is effected.

To actuate the device, motor 26 is connected to a power supply by cord 30. Switch 31 permits one to operate and reverse the motor in its direction of movement.

I claim:

1. Device for adjusting the angular position of a pivotable supporting surface, particularly the head section of a bed frame for supporting the head end of a mattress, characterized in having two rectangular frames (1, 3) which are hinged together along a pivot axis (2) extending between two edges of said frames (1, 3), one frame (1) serving as the base member to be placed horizontally upon a foundation surface, and the other frame (3) constituting the supporting surface which is adjustable to various angular positions with respect to the horizontal base frame (1), said frames (1, 3) being adapted to be spread apart by increasing the angle between said frames by means of at least one torsion spring rod (6, 7) disposed alongside said pivot axis (2) between said frames (1, 3), and at least one pneumatic spring (12, 13) likewise disposed between and braced against said frames (1, 3), said two frames (1, 3) being connected to each other by flexible pull means (14, 21) which are in cooperation with drive means (19, 26) secured on one said frame (1) to enable said frames (1, 3) to move toward and away from each other against the action of said torsional spring rods (6, 7) and said pneumatic springs (12, 13) for the purpose of achieving an infinitely variable adjustment of the angle between said two frames (1, 3).

2. Device according to claim 1, characterized by having two torsion spring rods (6, 7) extending parallel to said pivot axis (2) and to each other secured with one end to the respective opposite side of one said frame (1), while the other end being at an angle to the horizontal run, is in engagement with roller means (10, 11) which are provided on opposite sides of said other frame (3).

3. Device according to claim 2, characterized in that two pneumatic springs (12, 13) are provided, each of which being jointed with one end to opposite sides of said frame (1) and with other end to opposite sides of the other said frame (3).

4. Device according to claim 3, characterized in that one said torsion spring rod (6, 7) and one said pneumatic spring (12, 13) are so arranged on the same said frame side that, as the angle between two said frames (1, 3) increases and the resilient force of the pretensioned torsion spring rod decreases, the force of the pneumatic spring is continuously increasing to effect an increase in the angular distance between said frames.

5. Device according to claim 4, characterized in that said flexible pull means are steel cables (14, 21) secured with one end to each of the opposite sides of said one frame (3), said two steel cables (14, 21) being trained over pulleys (15, 16, 17, 22, 23, 24) provided on said other frame (1), while their other ends are fastened to a pivot lever (19) provided on said other frame (1), said lever (19) being adapted to be operated by an electric hoisting motor (26) disposed on said frame (1) and being linked to said pivot lever by means of a threaded spindle.

6. Device according to claim 5, characterized in that a pneumatic spring (29) augmenting the action of the hoisting motor (26) is hingedly attached with one end to said pivot lever (19) and with the other end is braced against said frame (1) supporting said pivot lever (19), and in that the combined force of said pneumatic spring (29) and said motor (26) imparted to said pivot lever (19) is greater in any angular position of said pivotable frame (3) than the combined force of said torsion spring rods (6, 7) located near said pivot axis (2) and said pneumatic springs (12, 13) and transmitted to said pivot lever (19) by the way of said steel cables (14, 21).

7. Device according to claim 1, characterized in that two pneumatic springs (12, 13) are provided, each of which being jointed with one end to opposite sides of said frame (1) and with the other end to opposite sides of the other said frame (3).

8. Device according to claim 1, characterized in that one said torsion spring rod (6, 7) and one said pneumatic spring (12, 13) are so arranged on the same said frame side that, as the angle between two said frames (1, 3) increases and the resilient force of the pretensioned torsion spring rod decreases, the force of the pneumatic spring is continuously increasing to effect an increase in the angular distance between said frames.

9. Device according to claim 1, characterized in that said flexible pull means are steel cables (14, 21) secured with one end to each of the opposite sides of said one frame (3), said two steel cables (14, 21) being trained over pulleys (15, 16, 17, 22, 23, 24) provided on said other frame (1), while their other ends are fastened to a pivot lever (19) provided on said other frame (1), said lever (19) being adapted to be operated by an electric hoisting motor (26) disposed on said frame (1) and being linked to said pivot lever by means of a threaded spindle.

10. Device according to claim 9, characterized in that a pneumatic spring (29) augmenting the action of the hoisting motor (26) is hingedly attached with one end to said pivot lever (19) and with the other end is braced against said frame (1) supporting said pivot lever (19), and in that the combined force of said pneumatic spring (29) and said motor (26) imparted to said pivot lever (19) is greater in any angular postion of said pivotable frame (3) than the combined force of said torsion spring rods (6, 7) located near said pivot axis (2) and said pneumatic springs (12, 13) and transmitted to said pivot lever (19) by the way of said steel cables (14, 21).

* * * * *